US006770014B2

(12) United States Patent
Amore

(10) Patent No.: US 6,770,014 B2
(45) Date of Patent: Aug. 3, 2004

(54) RESISTANCE TYPE EXERCISE DEVICE

(76) Inventor: Robert W. Amore, 430 W. 34th St., New York, NY (US) 10001

( * ) Notice: Subject to any disclaimer, the term of this patent is extended or adjusted under 35 U.S.C. 154(b) by 234 days.

(21) Appl. No.: 09/956,707

(22) Filed: Sep. 20, 2001

(65) Prior Publication Data

US 2003/0054924 A1 Mar. 20, 2003

(51) Int. Cl.[7] ..... A63B 21/00

(52) U.S. Cl. ..... 482/92; 482/115; 482/116; 482/120; 482/121

(58) Field of Search ..... 482/92, 74, 110, 482/114, 115, 116, 118, 120–122, 124, 126, 127, 148, 907–909

(56) References Cited

U.S. PATENT DOCUMENTS 4,114,874 A * 9/1978 Mattila ..... 482/55
4,884,800 A * 12/1989 Duke ..... 482/73
5,271,416 A * 12/1993 Lepley ..... 600/595
6,315,701 B1 * 11/2001 Shifferaw ..... 482/114

* cited by examiner

*Primary Examiner*—Nicholas D. Lucchesi
*Assistant Examiner*—Tam M Nguyen
(74) *Attorney, Agent, or Firm*—Barry G. Magidoff

(57) ABSTRACT

The present invention relates to a resistance type exercise device that uses frictional forces between members to provide resistance for a variety of different exercises. In operation, when a pull cord is withdrawn from the exercise device, a cord wheel converts the translational movement to rotational motion. A brake lever contacting a brake drum fixedly attached to the cord wheel provides a friction resistive force to the rotational motion. A recoil cord causes the recoil cord 900 to stretch and wrap around a bearing lug, placing the recoil cord in tension. The potential energy stored in the tensioned recoil cord is used to rewind the cord wheel and restore the pull cord back to its at rest position.

11 Claims, 12 Drawing Sheets

RESISTANCE TYPE EXERCISE DEVICE

FIELD OF INVENTION

The present invention relates to a resistance type exercise device, and more particularly, to an exercise device that uses frictional forces between members to provide resistance for a variety of different exercises, including an exercise using the back-and-forth translational movement of the arms to provide fixed or variable resistance to the muscles of the body.

BACKGROUND OF INVENTION

Health and fitness are of paramount importance to many people—young and old. Some of the most popular activities to improve physical fitness and health include walking, running, jogging, skating, or some other lower body intensive activity. Although these activities improve cardiovascular fitness and exercise the lower body, they do not provide substantial exercise for the upper body.

Various exercise devices have been proposed that are intended as accessories in walking, jogging, resistance training or aerobics, and are well known in the prior art. Some of these devices rely on the user to provide resistance. For example, U.S. Pat. Nos. 4,441,707 (Bosch) discloses an exercise belt for aerobic activities. The belt encircles the waist and houses a flexible line which terminates at each end in a handle. However, this device does not have any means of imparting resistance to the line. Instead, the user must supply his own resistance by pushing forward on one handle while resisting the backward movement of the other handle. Therefore, it is difficult for the user of this device to maintain a consistent resistance throughout the range of motion during an extended time period of use.

Some attempts have been made to provide a workout device which imparts resistance to the user. As shown by U.S. Pat. Nos. 4,557,480; 4,174,832; 4,114,875; and 3,885,789. These devices all provide rotatable pulleys having a length of cord operatively wound thereabout and provide the necessary resistance to unwinding the exercise cord by either establishing a compressive force against the cord itself or by winding the cord about one or a series of capstands. Such structural limitations give rise to various operational limitations and further cause the exercise cord to wear excessively during the use of the exercise device, thus reducing the efficiency and life of the exercise device. One skilled in the art will readily recognize that the prior art methods of providing resistance to the unwinding of the exercise cord militates against accurate adjustment of the resistance as well as limiting the degree of resistance which can be attained.

Other devices rely on cables and pulleys to provide resistance. For example, U.S. Pat. Nos. 5,618,249; 5,795,274; 4,779,866; and 5,876,310 provides a frictional force against a pulley or cable spool to impart resistance against the rotational movement of the pulley by a flexible cord or cable. Other devices, such as those disclosed in U.S. Pat. No. 5,733,231 impart a biasing resistance to the pulley or spool by the uses of a spiral coiled spring. Although some of these devices provide variable resistance, one of skill in the art would similarly recognize that these devices militate against accurate adjustment of the resistance, as well as limiting the degree of resistance which can be attained. In addition, the components used to achieve the resistance have structural limitation which often lead to the failure of such mechanisms. Coil springs that are used to provide resistance can be easily over wound causing fatigue or failure. Similarly, friction disks and pulley devices can be warped or fail under high compressive loading.

What is need is a resistance type exercise device that can provide a simple and reliable resistance to rotational movement imparted on a pulley.

What is also needed is a resistance type exercise device that can provide accurate adjustment of friction forces.

SUMMARY OF INVENTION

It is an object of the present invention to solve the above stated limitations of traditional exercise devices. To accomplish these objectives, the resistance exercise device of the instant invention comprises a housing, including a base housing, a top cover, and a hub shaft. The top cover covers the base housing to form an enclosure. The hub shaft is joined to an inside surface of the base housing and oriented substantially perpendicular to the inside surface of the base housing so as to project towards the top cover.

A pull cord capable of substantially translation movement upon receiving a pull force is also included. The pull cord is wound about a cord wheel when in the retraced position. The cord wheel is rotatably mounted on the hub shaft in the housing allowing for the conversion of the substantially translational movement of the pull cord to rotational motion.

A brake drum rotatably mounted on the hub shaft in the housing is also included. The brake drum is concentrically oriented with the cord wheel, and capable of interfacing with and rotating with the cord wheel by means of an interface mechanism. A brake lever is mounted to the housing and contacts the brake drum, providing frictional resistance to the rotation of the brake drum.

A recoil mechanism is also included and attached between the cord wheel and housing for recoiling the pull cord on the cord wheel during retraction.

DETAILED DESCRIPTION OF THE INVENTION

The core component of the exercise device heretofore described is a frictional resistance unit. The frictional resistance unit may come in many shapes and sizes, the variations of which will be apparent to one of ordinary skill in the art. However, the basic concept and operation of the frictional resistance unit remains the same in each unit.

Figure 1:
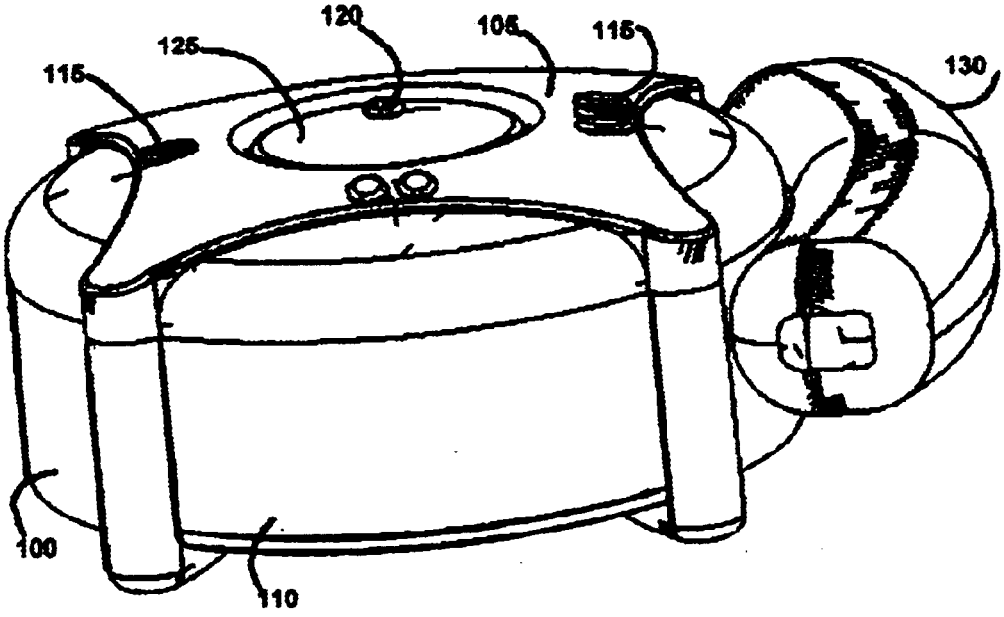
FIG. 1 shows an assembled view of the frictional resistance unit according to one embodiment of the present invention.

An assembled view of the frictional resistance unit according to an embodiment of the present invention is illustrated in FIG. 1. In its simplest form, the frictional resistance unit 100 converts translational movement to rotation movement, and imparts a frictional force to resist the rotational motion. This ultimately provides resistance to the translation movement imparted to the frictional resistance unit 100.

The frictional resistance unit 100 comprises a top cover 105 rotatably connected to a base housing 110. The top cover 105 may rotate in relation to the base housing 110, causing an increase or decrease in the frictional resistive forces created by the frictional resistive unit 100. The base housing incorporates a hub shaft (not shown) that terminates with a hub cap 120 protruding through an opening in top cover 105.

Resistance level indicators 115 are incorporated into the top surface of the top cover 105 to indicate the relative resistive forces created by the frictional resistance unit 100. These indicators, may be, for example, embossed, etched or molded in the top surface of the top cover as shown. Similarly, a stationary indicator 125 is incorporated into the top surface of the hub cap 120 to indicate the relative resistive forces created by the frictional resistance unit 100. Together, the resistance level indicators 115 and stationary indicator 125 allow a user to select an appropriate level of resistance. For example, by rotating the top cover 105, a user can select a resistance level by aligning the appropriate resistance level indicator 115 with the stationary indicator 125.

As disclosed earlier, frictional resistance unit 100 operates as an exercise device by converting the translational movement imparted by a user to rotational motion, and then providing a frictional force to retard the rotational motion. In one embodiment of the invention, the translational movement is provided by a user pulling on a handle 130. Handle 130 is attached to a retractable pull cord 135 (not shown) that is spooled around a cord wheel (not shown) internal to the frictional resistance unit 100.

Figure 2B:
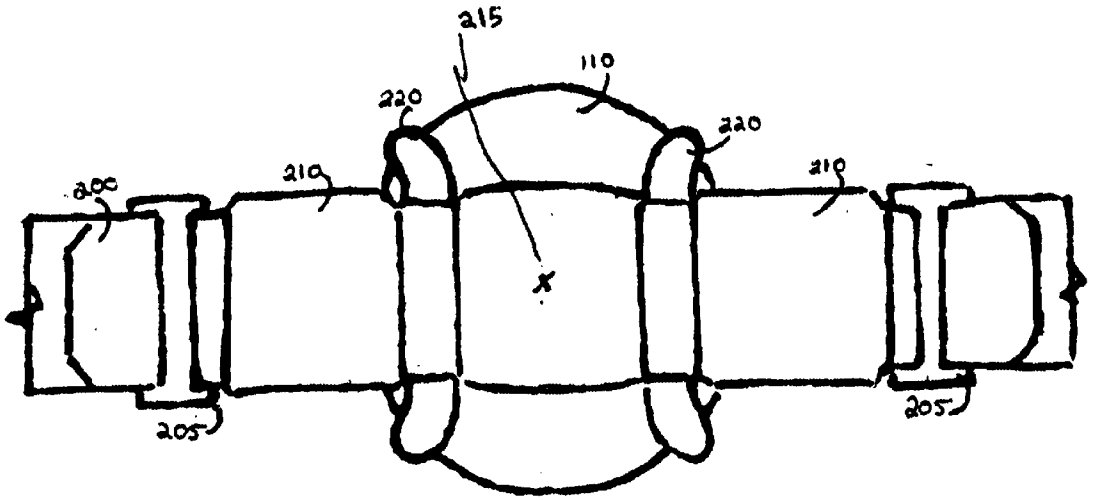
FIG. 2B show a rear elevation view of the attachment between the frictional resistance unit and a belt according to one embodiment of the invention.
Figure 2A:
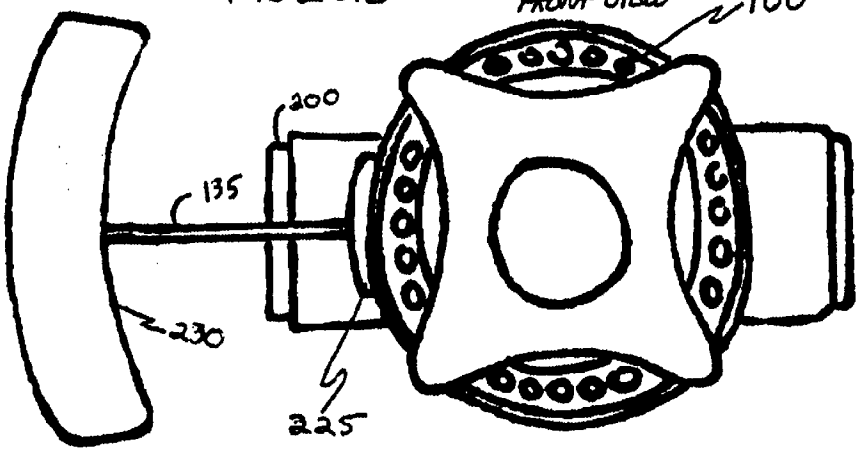
FIG. 2A shows a front elevation view of the frictional resistance unit attached to a belt according to one embodiment of the invention.

To exercise the upper body during aerobic activity, the frictional resistance unit 100 may be attached to a belt or similar device and worn around a user's waist. FIG. 2A shows a front a elevation view of the frictional resistance unit 100 attached to a belt 200 according to one embodiment of the invention. In the embodiment shown, the belt 200 is passed behind and attached to the frictional resistance unit 100, allowing for the unobstructed rotation of the top cover 105, and translation of handle 130 and pull cord 135.

Many methods that can be employed to attached the frictional resistance unit 100 to the belt 200 as would be apparent to one of skill in the art. FIG. 2B show a rear elevation view of the attachment between the frictional resistance unit 100 and the belt 200 according to one embodiment of the invention.

In the embodiment shown, an aperture 215 is incorporated into the back of the base housing 110 allowing the belt 200 to pass through the base housing 110, without interfering with the operation of the frictional resistance unit 100. The belt 200 is then place through rubber slip pads 210 which diametrically encircle the belt. When in place, a first edge of the rubber slip pads 210 abut retainer lugs 220 incorporated in the base housing 110. Adjustment clips 205 are installed on the belt 200 adjacent to the rubber slip pads 210 so as to abut a second edge of the rubber slip pads. The adjustment clips 205 are pulled tight against the rubber slip pads 210 causing the rubber slip pads 210 to contact the retain lugs 220 incorporated into base housing 110, thus affixing the frictional resistance unit 100 to belt 200.

Figure 10:
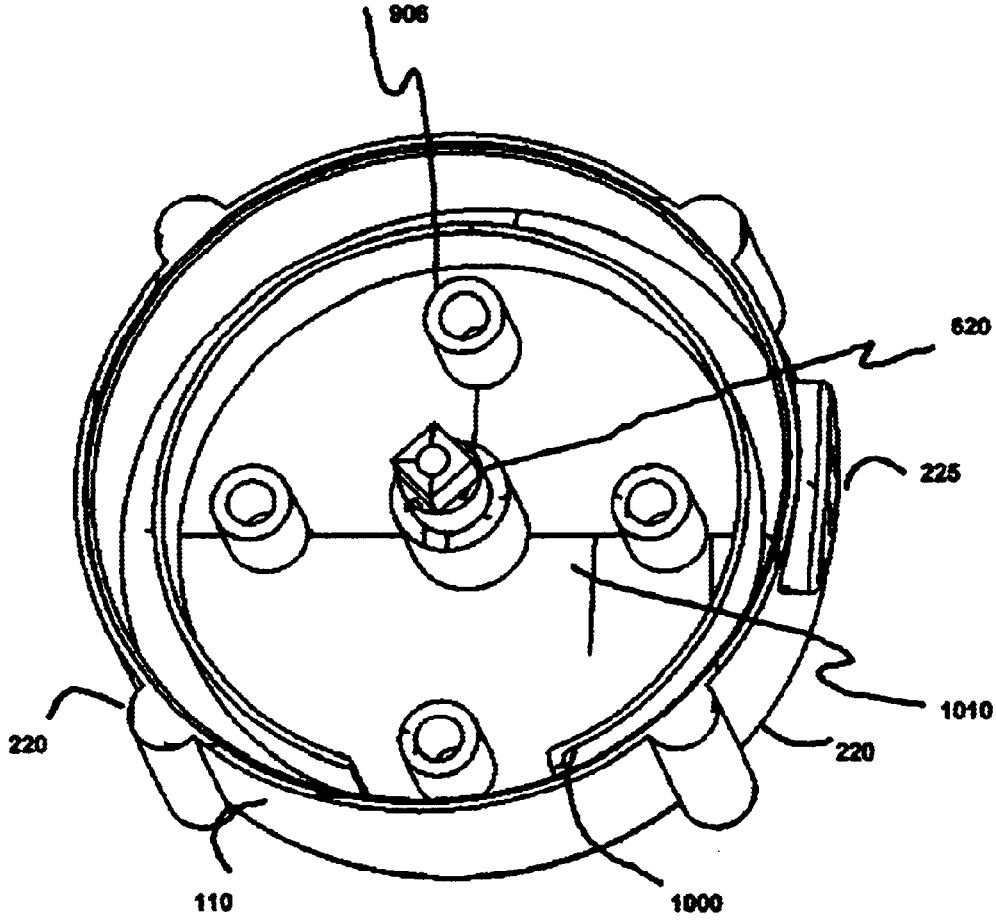
FIG. 10 shows a perspective view of the base housing for the frictional resistance unit according to one embodiment of the invention.

In another embodiment of the invention the retainer lugs may be smooth cylindrical extension integrated into the bottom side of base housing 110 as shown in FIG. 10. The belt 200 may be attached to the base housing 110, and thus the frictional resistance unit 100, by threading a free end of belt 200 through retainer lug 220, and then back onto itself. Adjustment clip 205 may be used to secure belt 200 to itself as is well known in the art.

Figure 2C:
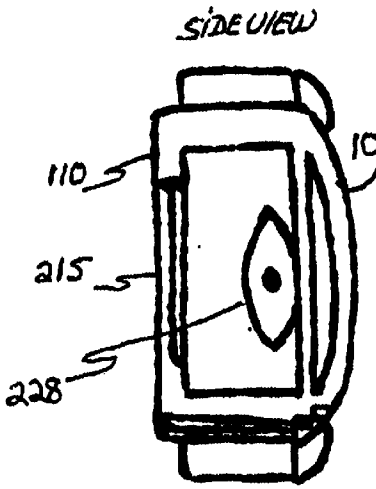
FIG. 2C shows a side elevation view of the frictional resistance unit according to one embodiment of the present invention.

FIG. 2C shows a side elevation view of the frictional resistance unit 100 according to one embodiment of the present invention. In the embodiment shown, handle lug 225 is incorporated into the side of the base housing unit 110 and designed to fit into a lug recess 230 (see drawing 2A) in handle 130. When the handle lug 225 and lug recess 230 are engaged, handle 130 is prevented from spinning or rotating when not in use.

Aperture 215 is also illustrated in FIG. 2C showing the location that the belt 200 passes through the base housing 110 according to one embodiment of the invention.

Figure 3B:
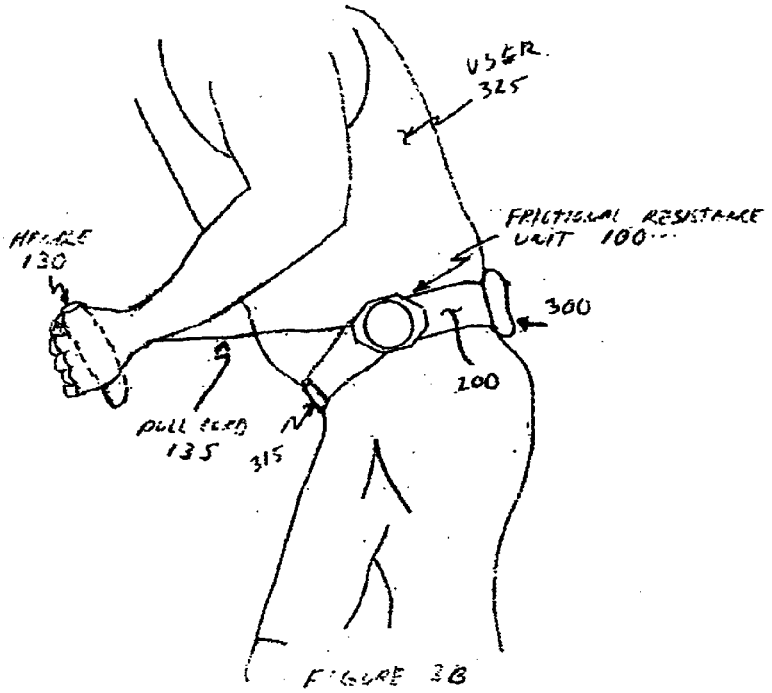
FIG. 3B shows a perspective view of the resistance exercise device being worn and used by a user according to one embodiment of the invention.
Figure 3A:
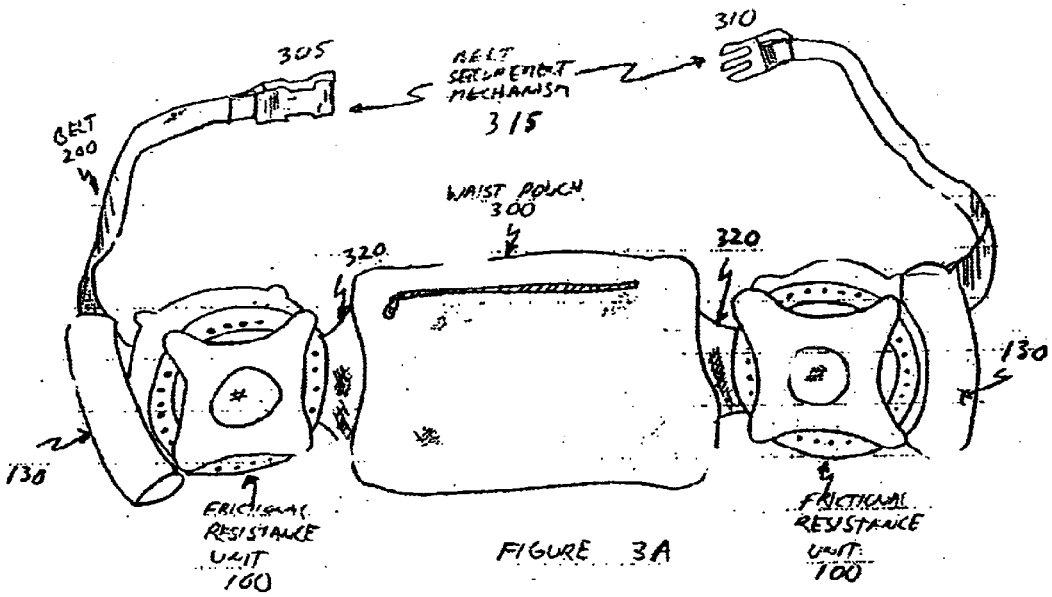
FIG. 3A shows a perspective view of the inventive exercise device according to one embodiment of the invention.

A perspective view of the inventive exercise device according to one embodiment of the invention is shown in FIG. 3A. As shown, the exercise device incorporates two frictional resistance units 100 affixed to the belt 200.

The belt member 200 includes a first end 305, a second end 310, a body section 320, and a securement mechanism 315. A waist pouch 300 may be integrated within the body section 320 and provide an enclosed receptacle for storage of small items during exercise. The securement mechanism 315 secures the first and second ends, 305 and 310, to each other for fastening the belt member 200 around the waist of a person. The securement mechanism 315 may be any one of the variety of well know securement devices, including Velcro, a traditional buckle, snap buckle (as shown), snap hook, etc.

A perspective view of the inventive resistance exercise device being worn and used by a user according to one embodiment of the invention is shown in FIG. 3B. In the embodiment illustrated, the belt member 200, incorporating two frictional resistance units 100 (one shown) is fastened around the waist of a user 325 by way of the belt securement mechanism 315. The body section 320 of belt member 200 also incorporates a waist pouch 300. The exercise device is operated by the user 325 grasping handle 130 and pulling on the handle 130 to extract pull cord 135 from the frictional resistance unit 100. This pulling motion provides the translational movement that is converted to rotational motion by the frictional resistance unit 100.

Figure 4:
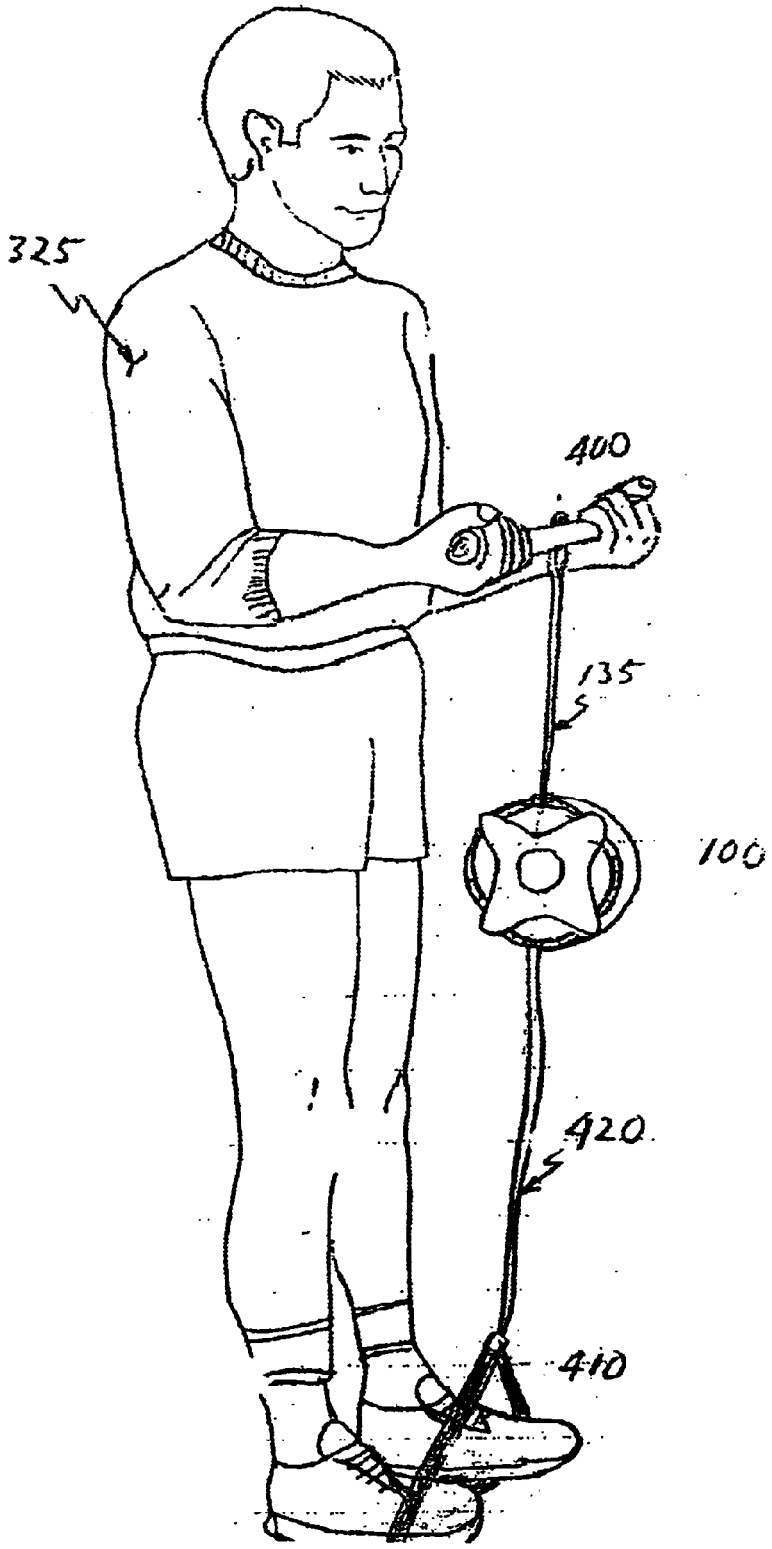
FIG. 4 shows a human user performing a curling exercise with the frictional resistance unit according to one embodiment of the invention.
Figure 5:
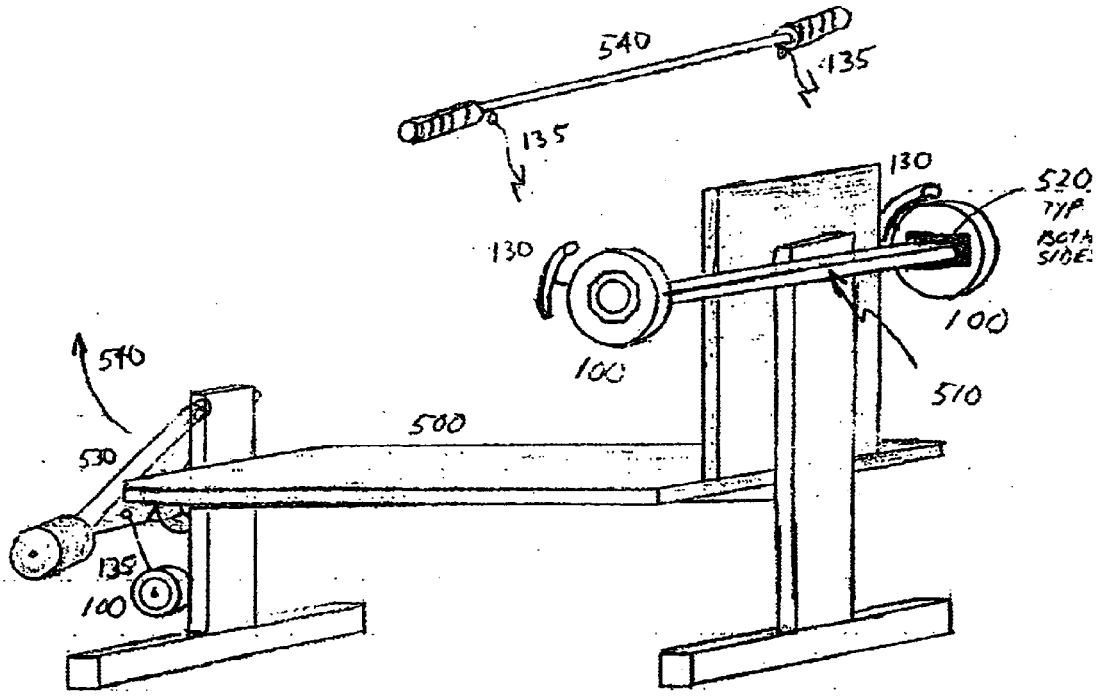
FIG. 5 shows a rear perspective view of still another alternative embodiment of the present invention, in which the frictional resistance units are used in conjunction with an exercise bench to exercise various other parts of the body.

Aside from being worn on the waist by a user, the resistance exercise device may be used in other applications. A perspective view of the inventive resistance exercise device being used in two other applications is illustrated in FIGS. 4 and 5. These representations are provided for the purpose of example, and are not to be construed as limiting the scope of uses for the resistance exercise device.

FIG. 4 shown a human user performing a curling exercise with the frictional resistance unit 100 according to one embodiment of the invention. The curling exercise is usually performed with a barbell or weight machine and it is the purpose of FIG. 4 to show one example of how the frictional resistance unit 100 can be substituted for a barbell or weight machine in weight training. The user simply dials the desired resistance setting by aligning the appropriate resistance level indicator 115 (not shown) with the stationary indicator 125 (not shown) on the frictional resistance unit 100 just as if it were a weight setting. The user then used the exercise device as if it were a barbell weighing the dialed amount.

The frictional resistance unit 100 shown in FIG. 4 comprises retractable pull cord 135 and detachable curl bar 400. Various other types of hand or ancillary exercise attachments can be fastened to the end of pull cord 135 in order to meet the requirements of various exercise routines. Examples of different ancillary exercise attachments may include: hand loop grips; head harnesses; ankle straps; leg/foot slings, etc. The exercises that can be performed by this invention are not limited to any specific type of ancillary exercise attachment fastened to the end of pull cord 135.

To properly use the frictional resistance unit 100 for exercise in the configuration illustrated in FIG. 4, the unit must be held in a relatively stationary position. To maintain this stability various ancillary support attachment may be used. In the embodiment shown, a first end of an adjustable support line 420 having a first and second end is attached to the frictional resistance unit 100. This connection may be, for example, a positive locking snap hook and D ring system that can be easily attached and detached. A foot strap 410 may be attached to the second end of the support line by a similar means, allowing the user to anchor one end of the exercise device with his feet. Other ancillary support attachments may include, for example a wall fitting or ceiling fitting for attaching the second end of the support line 420 to a wall, ceiling or other fixed support. It will be understood that a wide variety of such fittings are contemplated, and this invention is not limited to any specific type or location of fitting, or any specific type of location of line, or any specific type or location of foot rest or other fixed support.

FIG. 5 shows a rear perspective view of still another alternative embodiment of the present invention, in which the frictional resistance units 100 are used in conjunction with an exercise bench 500 to exercise various other parts of the body.

The exercise bench 500 illustrated is equipped with three frictional resistance units 100. Two frictional resistance units 100 are attached to the end of a support bracket 510 running substantially horizontal across the back of the bench 500 rear support. The support bracket 510 may be affixed to the bench 500 by any mechanical or other means as are well known in the art. Attachment brackets 520 are fastened to each end of the support bracket 510 by a similar mechanical or other means, and are adapted to connect frictional resistance units 100 by any satisfactory means. In one embodiment of the invention, the frictional resistance units 100 may be attached to the attachment brackets 520 by threading a belt through the base housing 110 of the frictional resistance units as described in FIG. 2 above. In another embodiment of the invention, the base housing 110 of the frictional resistance units 100 may be mechanically fastened to the attachment brackets 520. Various mechanical attachments methods are well know in the art.

In these embodiments, the exercise device is operated by the user grasping handles 130 and pulling on the handle 130 to extract retractable pull cord 135 (not shown) from the frictional resistance units 100 against the frictional resistance supplied by the unit.

Alternatively, a press bar 540 may be attached to the retractable pull cords 135 in place of handles 130. As disclosed in FIG. 4 above, the press bar 540 may be attached to retractable pull cord by a mechanical means, such as a positive locking snap hook and D ring system. A user may exercise on the device by grasping press bar 540 and pulling or pushing the bar away from the frictional resistance units 100.

FIG. 5 also illustrates another alternative embodiment of the present invention, in which a frictional resistance units 100 is used in conjunction with the exercise bench 500 and a leg curl station 530 to exercise the user's legs. In this embodiment, one end of the frictional resistance unit 100 is attached to the lower front leg support of bench 500. The unit may be attached by any mechanical means, including the aforementioned positive locking snap hook and D ring system attached to an adjustable support line 420 (not shown). The retractable pull cord exiting the opposite end of the frictional resistance unit 100 is affixed to the leg curl station 530. In operation, as the user uses his legs to extend the leg curl station along direction 540, the frictional resistance unit 100 provides resistance to motion.

As disclosed earlier, the core component of the resistance type exercise device is the frictional resistance unit 100. As illustrated in FIGS. 6 through 10, an embodiment of the frictional resistance unit comprises several key elements, the majority of which are internal to the base housing 110 and top cover 105.

Figure 6A:
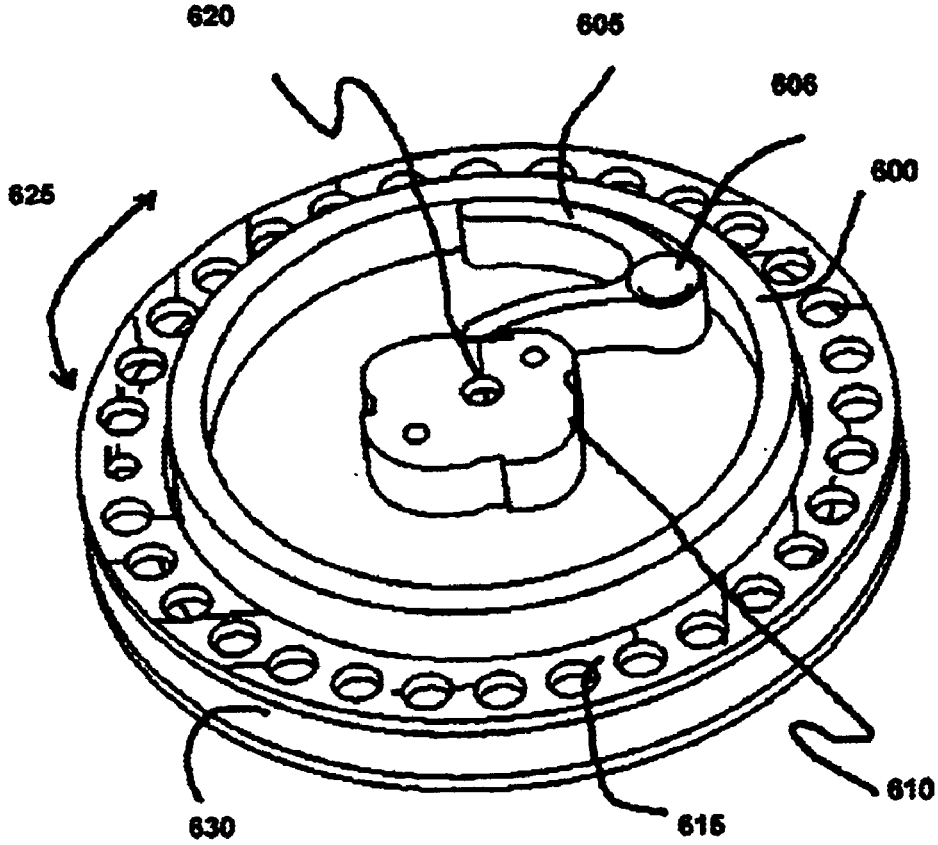
FIG. 6A shows the components that supply the variable frictional resistance against the rotational movement according to one embodiment of the invention.
Figure 6B:
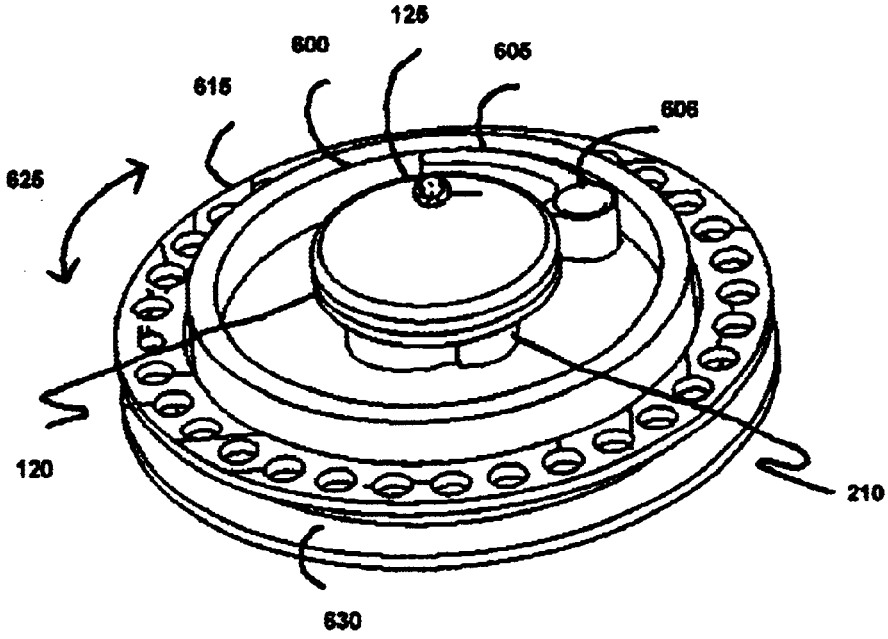
FIG. 6B shows the components that supply the variable frictional resistance against the rotational movement according to one embodiment of the invention.

Referring to FIGS. 6A and 6B, the components that supply the variable frictional resistance against the rotational movement according to one embodiment of the invention are shown. A cord wheel 615 having parallel first and second sides, and a circumferential groove 630 there between, is rotatably mounted to hub shaft 620, allowing the cord wheel 615 to freely rotate about the hub shaft 620 axis. In an initial retracted position, the retractable cord 135 (not shown) is wound around the circumferential groove 630 in cord wheel 615. As the cord is pulled from, or retracted into, the frictional resistance unit 100 by the user, the cord wheel 615 axially rotates in a clockwise or counter-clockwise direction about hub shaft 620 as shown by direction 625.

A brake drum 600 having parallel first and second sides is rotatably mounted to hub shaft 620, allowing the brake drum 600 to freely rotate about the hub shaft 620 axis. The brake drum 600 and cord wheel 615 are concentrically oriented with the brake drum 600 located on top of the cord wheel 615 so as to allow the second side of brake drum 600 to interface with the first side of cord wheel 615 as described below. Preferably, the second side of brake drum 600 fits into a recessed area in the first side of cord wheel 615, but the two components are allowed to rotate independent of each other.

Figure 7:
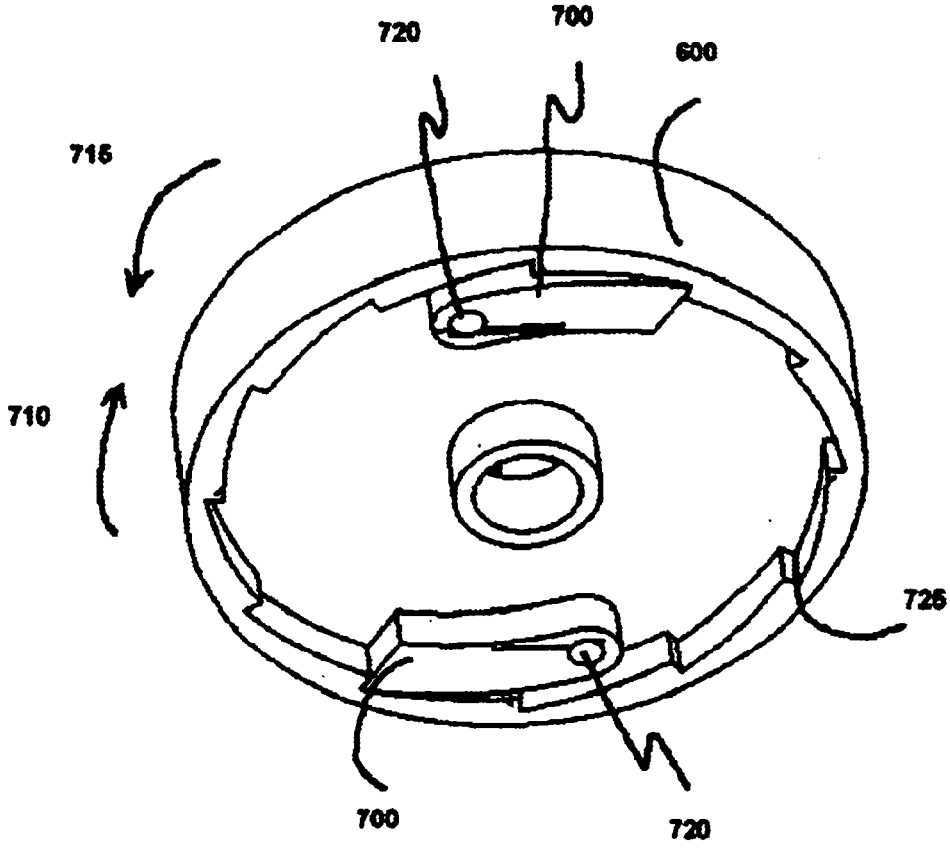
FIG. 7 shows a perspective view of the underside of a brake drum frictional resistance component according to one embodiment of the present invention.
Figure 8:
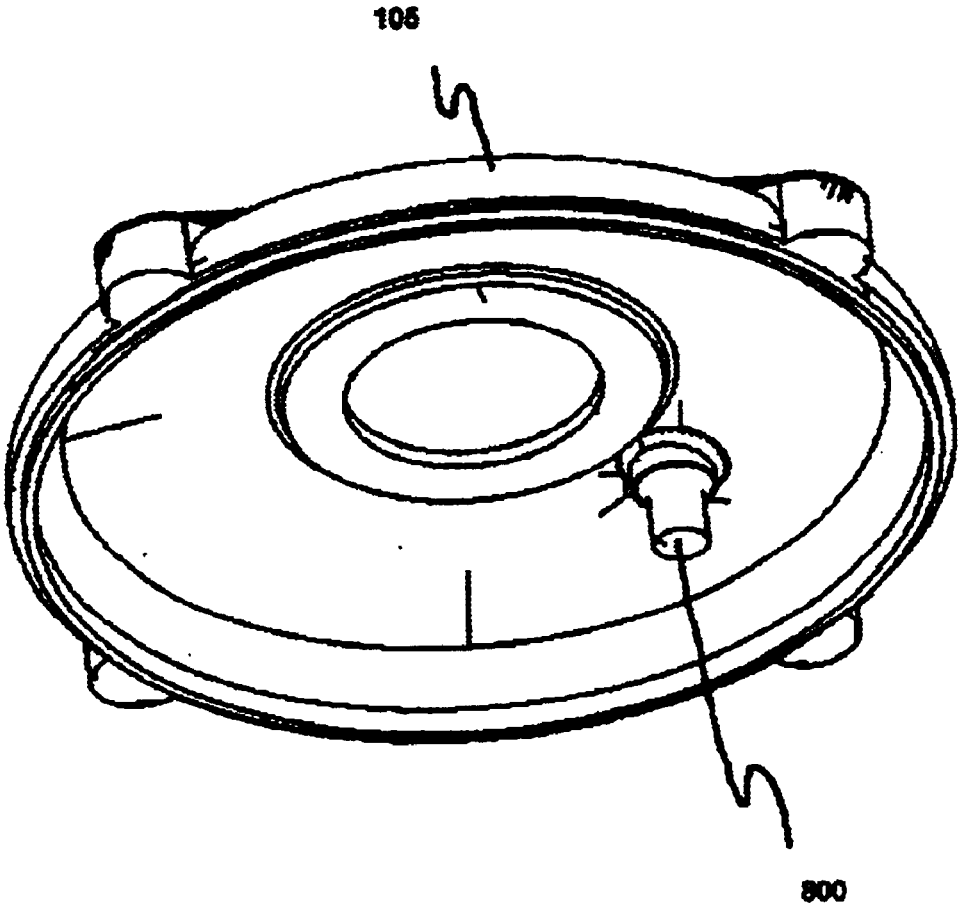
FIG. 8 shows a perspective view of the underside of the top cover for the frictional resistance unit according to one embodiment of the present invention.

Turning now to FIG. 7, the second side of brake drum 600 interfaces with and is connected to the first side of cord wheel 615 through a ratcheting mechanism. The ratcheting mechanism is comprised of ratchet arms 700 and ratcheted inner rim 725. In a preferred embodiment, the ratchet arms 700 and ratcheted inner rim 725 each have ratchet teeth capable of engaging in a meshing fashion when the ratcheted inner rim 725 is rotated in one direction with relation to the ratchet arms 700.

Ratchet arms 700 are pivotally connected to the first side of cord wheel 615 at pivot points 720, and springingly biased to provide constant pressure along the ratcheted inner rim 725 of the second side of brake drum 600. In a preferred embodiment shown, the ratcheted inner rim 725 of brake drum 600 is located on the underside of the brake drum 600 assembly, so as not to interfere with the operation of cam 610 and brake arm 605 shown in FIGS. 6A and 6B. Accordingly, the ratcheting mechanism allows the cord wheel 615 to freely rotate in relation to brake drum 600 in one rotational direction (direction 710), and rigidly connect to and rotate with brake drum 600 in the other rotational direction (direction 715).

Turning again to FIGS. 6A and 6B, a cam 610 is fixedly mounted to hub shaft 620 and remains stationary with relation to hub shaft 620. In a preferred embodiment shown in FIG. 10, hub shaft 620 comprises three sections: two sections of circular cross-section (a first and second section); and a square third section. The cord wheel 615 and brake drum 600 are rotatably mounted to the first circular section and second circular section respectively, allowing for their free rotation about hub shaft 620. The cam 610 has a square center opening and is fixedly mounted to the square section at the end of hub shaft 620, providing stability and to preventing cam 610 from rotating about hub shaft 620.

Each side of the cam has an indent for receiving a first end of brake lever 605. The distances (A, B, C, and D) from the center of hub shaft 620 to each indent varies, and the variation in these distances is directly related to the variable resistance of the frictional resistance unit 100 as will become apparent when explained below.

The brake lever 605 is a V-shaped member with a first and second end. An aperture 606 in brake lever 605 fits over post 800 (see FIG. 8) in the top cover 105, allowing the brake lever 605 to be secured in proper position, and further providing a pivot point for the rotational movement of brake lever 605. The first end of brake lever 605 slideably traverses along cam 610, while the second end of brake lever 605 contacts the inner surface of the first side of brake drum 600.

Brake lever 605 is composed of a resilient material, such as Delran that allows the first end of brake lever 605 to be displaced in relation to the second end of brake lever 605 by cam 610. The second end of the brake lever 605 is curved to match the curvature of the inner surface of the first side of brake drum 600. When the first end of the brake lever 605 is displaced, the brake lever 605 is rotated about post 800, urging the second end of brake lever 605 into the inner surface of the first side of brake drum 600.

In one embodiment of the invention, the resiliency inherent in brake lever 605 thus causes the break lever 605 to act as a spring, exerting a force on the inner surface of the first side of brake drum 600 proportional to the amount that the first end of brake lever 605 is displaced. Accordingly, the greater the first end of brake lever 605 is displaced, the greater the force exerted by the second end of brake lever 605 on brake drum 600. Since the frictional resistance provided by frictional resistance unit 100 is, at least in part, a function of the frictional forces between the brake 605 and the brake drum 600, the greater the displacement of the first end of brake lever 605, the greater the frictional resistance generated by the frictional resistance unit 100.

FIG. 6B also shown the position of the hub cap 120. Once the cord wheel 615, brake drum 600, cam 210 and brake 605 are positioned in the base housing 110 (not shown) the hub cap 120 is affixed to the end of hub shaft 620, providing an indicator for the user (stationary indicator 125) when "dialing" the desired level of frictional resistance, and retaining the aforementioned components in place.

Figure 9A:
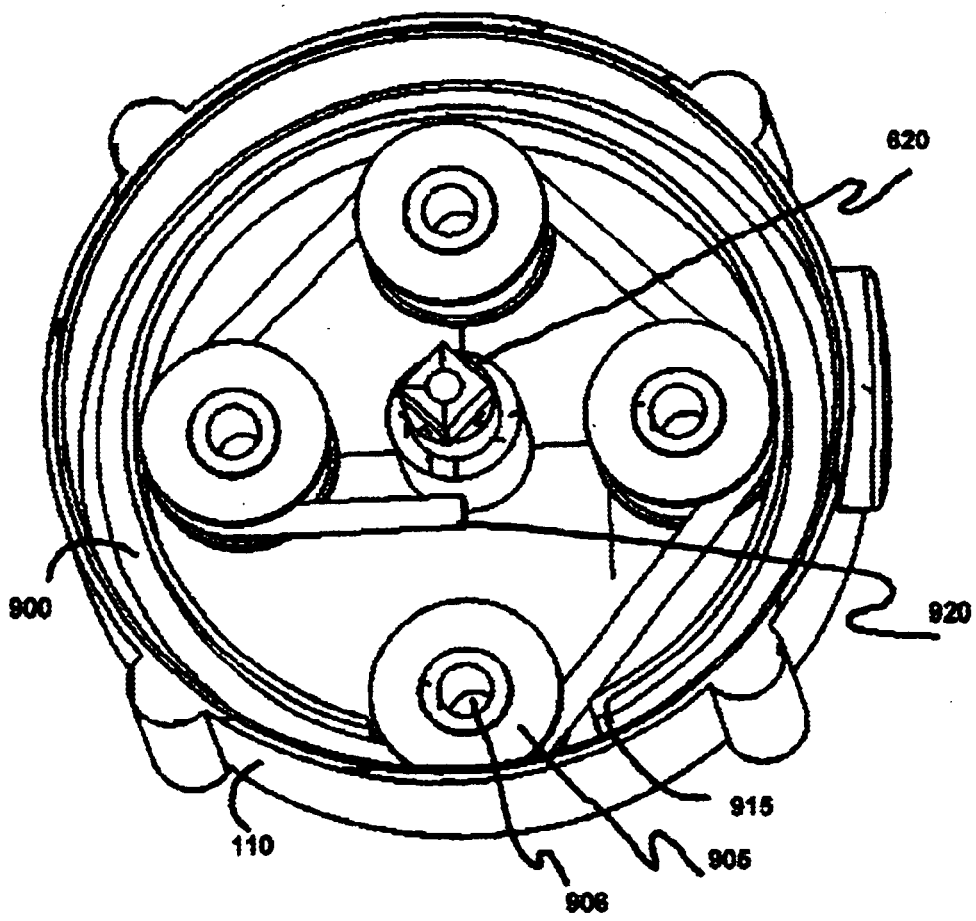
FIG. 9A shows a perspective view of a recoil mechanism according to one embodiment of the present invention.
Figure 9B:
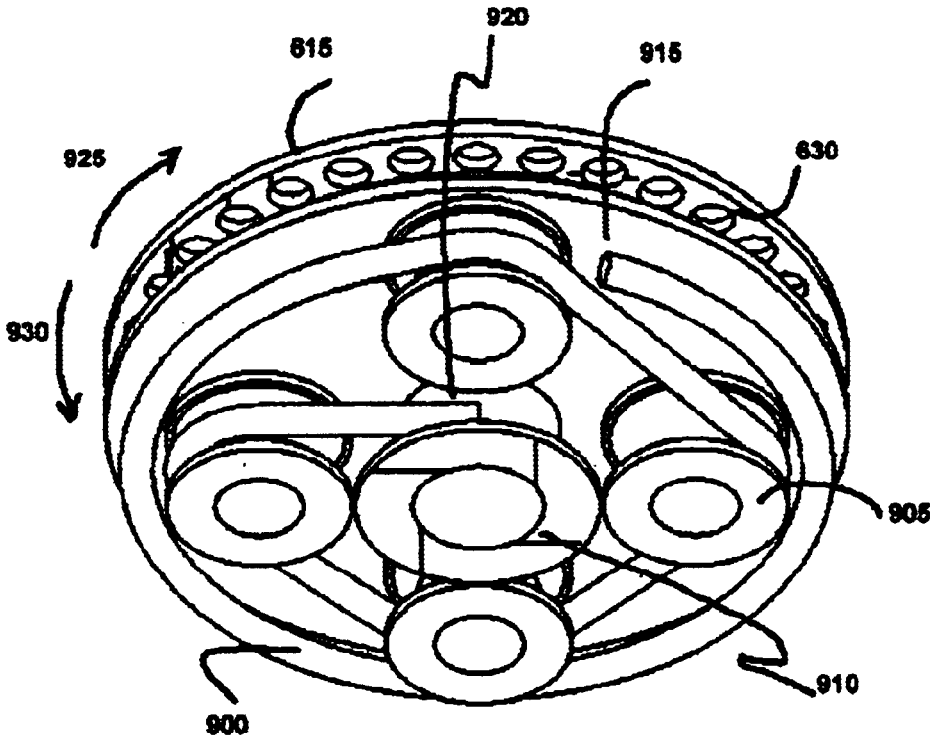
FIG. 9B shows a perspective view of some components of the recoil mechanism according to one embodiment of the present invention.

Once the pull cord 135 is extended from the frictional resistance unit 100, the cord must be retracted so that multiple repetitions of the exercise may be made. One method to retract the pull cord 135 is by a recoil mechanism. FIGS. 9A and 9B show perspective views of a recoil mechanism according to one embodiment of the present invention. In the embodiment illustrated in FIG. 9A, the recoil mechanism comprises base housing 110, recoil bearings 905, and recoil cord 900.

The energy supplied to power the recoil mechanism is provided by the recoil cord 900. The recoil cord 900 has a first end 915 and a second end 920. The recoil cord 900 may be any type of elasticized cord capable of storing energy when extended, and includes, for example bungee cords, rubber bands, shock cords, etc. The first end 915 of the recoil cord 900 is attached to the base housing 110. The recoil cord 900 is then wound around recoil bearings 905, and terminates with the second end 920 being attached to cord wheel 615 (not shown).

As illustrated in FIG. 9A, the recoil bearings 905 are attached to the inside surface of base housing 110 and allow for smooth motion of the recoil cord 900 during extension and retraction of pull cord 135. In one embodiment of the invention, the recoil bearings 905 are rotatably attached to the recoil bearing posts integrally formed into the inside surface of base housing 110, allowing the recoil bearings 905 to freely rotate about the recoil bearing post 906 when the recoil cord 900 moves during extension and retraction. In another embodiment of the invention, the recoil bearings 905 are fixedly attached to the inside surface of base housing 110, but provide a smooth surface for the recoil cord 900 to move when the recoil cord 900 is extended or retracted.

FIG. 9B is a perspective view showing the physical orientation of the recoil bearings 905 with relation to the cord wheel 615. As described above, the recoil bearings 905 are rotatably or fixedly attached to the inside surface of base housing 110 (not shown).

Also shown in FIG. 9B is bearing lug 910. Bearing lug 910 is fixedly attached to the second side of cord wheel 615 and provides a spool for the winding of recoil cord 900 as the frictional resistance unit 100 is operated. In addition, the bearing lug 910 provides a low friction surface between cord wheel 615 and base housing 110 (not shown).

In operation, when the pull cord 135 is withdrawn from frictional resistance unit 110, the cord wheel 615 rotates in direction 925. Since the recoil cord 900 is fixedly attached to the base housing 110 and cord wheel 615, the rotation of the cord wheel 615 causes the recoil cord 900 to stretch and wrap around bearing lug 910, placing the recoil cord 900 in tension. The potential energy stored in the tensioned recoil cord 900 is used to rewind the cord wheel 615 and restore the pull cord 135 back to its at rest position. It should be noted that the recoil cord has a limited coefficient of elasticity (inches of stretch per inch of recoil cord), and the pull cord 135 can not be longer than the total elasticity or "stretch range" of the recoil cord 900. For this reason, coiling the recoil cord 900 around the group of recoil bearings 905 provides a recoil cord 900 of sufficient length to "out stretch" the total length of the pull cord 135.

FIG. 10 is a perspective view of base housing 110 according to one embodiment of the invention. In the embodiment illustrated, recoil cord anchor 1000 is integrated into base housing 110, and provides the attachment point for the first end 915 of recoil cord 900.

Bearing lug receptor 1010 is integrally formed into the inside bottom surface of base housing 110, and provides a smooth low friction surface for the rotation of bearing lug 910. In one embodiment of the invention, a low friction material, such as Teflon®, polyethylene or nylon may be adhered to the base housing 110 at the location of bearing lug receptor 1010 to provided a low friction bearing surface between bearing lug receptor 1010 and bearing lug 910.

FIG. 10 also illustrates the three section hub shaft 620, handle lug 225 and retainer lugs 220 described earlier. In the preferred embodiment shown, hub shaft 620 comprises three sections: two sections of circular cross-section (a first and second section); and a square third section. The cord wheel 615 and brake drum 600 are rotatably mounted to the first circular section and second circular section accordingly, allowing for their free rotation about hub shaft 620. The cam 610 has a square center opening and is fixedly mounted to the square section at the end of hub shaft 620, providing stability and to preventing cam 610 from rotating about hub shaft 620.

As described earlier, the retainer lugs 220 illustrated in FIG. 10 show a variation on the embodiment describe earlier in FIG. 2. In this embodiment, the base housing 110 does not necessarily have an aperture 215 in the back of base housing 110. Instead, the belt 200 is attached directly to the retainer lugs 220.

Handle lug 225 provides a smooth aperture for pull cord 135 to exit and enter base housing unit, and additionally provides a protrusion to accept lug recess 230 in handle 120. In one embodiment of the invention, the handle lug 225 may be integrally formed into base housing unit 110. In another embodiment of the invention, handle lug 225 is a separate component and may be affixed to base housing unit 110 by mechanical or other means.

FIG. 10 also show recoil bearing posts 906, which rotatably attach recoil bearings 905 to the base housing 110.

Operation

In a preferred embodiment, the user dials the desired resistance setting by aligning the appropriate resistance level indicator 115 with the stationary indicator 125 on the top cover 105 of the frictional resistance unit 100. This is achieved by rotating the top cover 105, which has the resistance level indicators 115 integrated into its top surface.

When the frictional resistance unit 100 is fully assembled, post 800, affixed to the underside of top cover 105, is inserted in the aperture 606 on brake lever 605. As the top cover 105 is rotated into the desired position, post 800 rotates with top cover 105 about hub shaft 620, effectively rotating the brake lever 605 about cam 610 until the desired cam profile is achieved. The cam profile is directly related to the frictional resistance imparted by the frictional resistance unit 100 to the user's motion as described above.

As the brake lever 605 is displace by the cam 610, the brake lever 605 exerts a force on the inner surface of brake drum 600 proportional to the displacement.

The frictional resistance exercise device is then operated by the user 325 grasping handle 130 or similar ancillary device and pulling on the handle 130 to extract pull cord 135 from the frictional resistance unit 100. The pull cord 135 is wound about cord wheel 615, inside the frictional resistance unit 100. This pulling motion provides the translational movement that is converted to rotational motion by pull cord 135 and cord wheel 615.

As the cord wheel 615 rotates about hub shaft 620, ratchet arms 700 connected to cord wheel 615 at pivot point 720 engage the ratcheted inner rim 725 on the second side of brake drum 600, causing brake drum 600 to rotated with cord wheel 615. The force applied by brake lever 605 on the inner rim of the first side of brake drum 600, causes a frictional resistance between the two members opposite to the rotation of brake drum 600, which is at lease in part, seen by the user 325 as resistance to the user's 325 translational movement.

As disclosed earlier, the first end 915 and the second end 920 of the recoil cord 900 are attached to the base housing 110 and cord wheel 615 respectively. Between these two attachment points, the recoil cord 900 is wound about a plurality of recoil bearings 905 as shown in FIG. 9A.

In operation, when the pull cord 135 is withdrawn from frictional resistance unit 110, the cord wheel 615 rotates in direction 925. Since the recoil cord 900 is fixedly attached to the base housing 110 and cord wheel 615, the rotation of the cord wheel 615 causes the recoil cord 900 to stretch and wrap around bearing lug 910, placing the recoil cord 900 in tension. At the recoil cord 900 elongates, there is some amount of linear movement of the recoil cord 900. To facilitate this movement, and prevent undue stress on the recoil cords 900, recoil bearings 905 rotate about recoil bearing posts 906 and provide minimal resistance to this linear movement.

The potential energy stored in the tensioned recoil cord 900 is used to rewind the cord wheel 615 and restore the pull cord 135 back to its at rest position when handle 130 is released or moved towards the retracted position.

In addition, the elongation and tensioning of recoil cord 900 provides some resistance to the pulling (translational) movement by the user, although the majority of resistance is provided by the friction between the brake 605 and brake drum 600.

It will be immediately apparent to those skilled in the art that variations and modifications to the disclosed embodiment are possible without departing from the spirit and scope of the present invention. The invention is defined by the appended claims.

What is claimed is:

1. A resistance exercise device comprising:

a) a housing comprising a base housing, a top cover, and a hub shaft, the top cover covering the base housing to form an enclosure, the hub shaft joined to an inside surface of the base housing and oriented substantially perpendicular to the inside surface of the base housing so as to project towards the top cover;

b) a pull cord capable of substantially translation movement upon receiving a pull force;

c) a cord wheel rotatably mounted on the hub shaft in the housing, the cord wheel storing the pull cord in the retracted position, and converting the substantially translational movement of the pull cord to rotational motion;

d) a brake drum rotatably mounted on the hub shaft in the housing, the brake drum being concentrically oriented with the cord wheel, the brake drum being capable of interfacing with and rotating with the cord wheel by means of an interface mechanism;

e) a brake lever mounted to the housing, the break lever contacting the brake drum and providing frictional resistance to the rotation of the brake drum;

f) a recoil mechanism attached between the cord wheel and housing for recoiling the pull cord on the cord wheel; the recoil mechanism comprising i) a plurality of recoil bearings, each recoil bearing being rotatably connected to a recoil bearing post, the recoil bearing post being jointed to the inside surface of the base housing and oriented substantially perpendicular to the inside surface of the base housing so as to project towards the top cover; and ii) a recoil cord having a first and second end, the recoil cord being constructed of a resilient material, the first end of the recoil cord being connected to the housing and the second end of the recoil cord being attached to the cord wheel.

2. The resistance exercise device of claim 1 wherein the interface mechanism comprises one or more ratchet arms and a ratcheted inner rim, the one or more ratchet arms and ratcheted inner rim each having ratchet teeth.

3. The resistance exercise device of claim 2 wherein the ratcheted inner rim is integrated into the brake drum and the ratchet arms are pivotally connected to the cord wheel, the cord wheel having pivot points to attached the ratchet arms, the ratchet arms being springingly biased to provide constant pressure along the ratcheted inner rim of the brake drum.

4. The interface mechanism of claim 2 wherein the ratchet teeth of the ratcheted inner rim are engaged by the ratchet teeth of the one or more ratchet arms when the cord wheel is rotated by the translational movement of the pull cord while allowing for the unimpeded retraction of the pull cord.

5. The resistance exercise device of claim 1 further comprising an adjustable means to selectively adjust the resistance.

6. The resistance exercise device of claim 1, wherein the recoil cord is an elasticized cord capable of storing energy when extended, and selected from the group consisting of bungee cords, rubber bands, and shock cords.

7. A resistance exercise device comprising:

a) a housing comprising a base housing, a top cover, and a hub shaft, the top cover covering the base housing to form an enclosure;

b) a pull cord capable of substantially translation movement upon receiving a pull force;

c) a cord wheel rotatably mounted on the hub shaft in the housing, the cord wheel storing the pull cord in the retracted position, and converting the substantially translational movement of the pull cord to rotational motion;

d) a brake drum rotatably mounted on the hub shaft in the housing, the brake drum being concentrically oriented with the cord wheel, the brake drum being capable of interfacing with and rotating with the cord wheel by means of an interface mechanism;

e) a brake lever mounted to the housing, the brake lever contacting the brake drum and providing frictional resistance to the rotation of the brake drum; and f. a recoil mechanism attached between the cord wheel and housing for recoiling the pull cord on the cord wheel wherein the brake lever is a v-shaped member having a first and second end, the brake lever being pivotally connected to the top cover, the top cover having a post to provide a pivot point for the brake lever.

8. The resistance exercise device of claim 7 further comprising an adjustable means to selectively adjust the resistance, wherein the adjustable means comprises a cam rigidly mounted to the hub shaft, the cam being slidably contacted by the first end of the brake lever pivoting the brake lever about the post in the top cover urging the second end of the brake lever into the brake drum.

9. The resistance exercise device of claim 8 wherein the cam has a plurality of cam profiles, each of the cam profiles being associated with a different level of resistance.

10. A resistance exercise device comprising:

a) a housing comprising a base housing, and a top cover, the top cover covering the base housing to form an enclosure, b) a pull cord capable of substantially translation movement upon receiving a pull force;

c) a cord wheel rotatably mounted on the inside surface of the base housing about an axis oriented substantially perpendicular to the inside surface of the base housing, so as to project towards the top cover, the cord wheel storing the pull cord in the retracted position, and converting the substantially translational movement of the pull cord to rotational motion;

d) a brake drum rotatably mounted on the base housing, the brake drum being concentrically oriented with the cord wheel, the brake drum being capable of interfacing with and rotating with the cord wheel by means of an interface mechanism;

e) a brake lever mounted to the housing, the brake lever contacting the brake drum and providing frictional resistance to the rotation of the brake drum;

f) a recoil mechanism attached between the cord wheel and housing for recoiling the pull cord on the cord wheel, wherein the recoil mechanism comprises:

i) a plurality of recoil bearings, each recoil bearing being connected to the inside surface of the base housing and oriented substantially perpendicular to the inside surface of the base housing so as to project towards the top cover; and ii) a recoil cord wound around the bearings and having a first and second end, the recoil cord being constructed of a resilient material, the first end of the recoil cord being connected to the housing and the second end of the recoil cord being attached to the cord wheel.

11. The resistance exercise device of claim 10 wherein the recoil mechanism further comprises:

a) a plurality of recoil bearing posts, each recoil bearing being rotatably connected to a recoil bearing post, the recoil bearing post being jointed to the inside surface of the base housing and oriented substantially perpendicular to the inside surface of the base housing so as to project towards the top cover.

* * * * *